US005263854A

United States Patent [19]

Bradshaw

[11] Patent Number: 5,263,854

[45] Date of Patent: Nov. 23, 1993

[54] UNWIND STATION

[76] Inventor: Franklin C. Bradshaw, 8621 E. Cheryl Dr., Scottsdale, Ariz. 85258

[21] Appl. No.: 851,075

[22] Filed: Mar. 13, 1992

[51] Int. Cl.[5] ..... B65H 25/22

[52] U.S. Cl. ..... 242/75.43; 242/72 B

[58] Field of Search ..... 242/75.4, 75.41, 75.43, 242/72 B

[56] References Cited

U.S. PATENT DOCUMENTS

| | | | |
|---|---|---|---|
| 3,029,038 | 4/1962 | Lotz | 242/75.41 |
| 3,398,914 | 8/1968 | Cunningham | 242/75.43 |
| 3,592,405 | 7/1971 | Young | 242/72 B |
| 3,885,797 | 5/1975 | Moss et al. | 242/75.43 |
| 3,904,197 | 9/1975 | Taitel et al. | 242/75.43 X |
| 4,074,873 | 2/1978 | Hayashi et al. | 242/75.43 |
| 4,143,829 | 3/1979 | Martin | 242/72 B X |
| 4,461,430 | 7/1984 | Lever | 242/72 B X |
| 4,591,879 | 5/1986 | Yokata et al. | 242/75.41 X |

*Primary Examiner*—Daniel P. Stodola
*Assistant Examiner*—Paul T. Bowen
*Attorney, Agent, or Firm*—Gregory J. Nelson

[57] ABSTRACT

An unwind station for supplying web materials from a roll at constant tension to a work station such as a press. The unwind station has a shaft with an arbor for receiving the web roll. A belt extends around a pulley on the shaft and a brake member which is mounted on one end of a pivotal beam. A biasing force is applied to the opposite end of the beam by a cylinder. The brake serves as a "dancer" to maintain constant tension. The arbor is provided with side-lay adjustment to align the web.

7 Claims, 2 Drawing Sheets

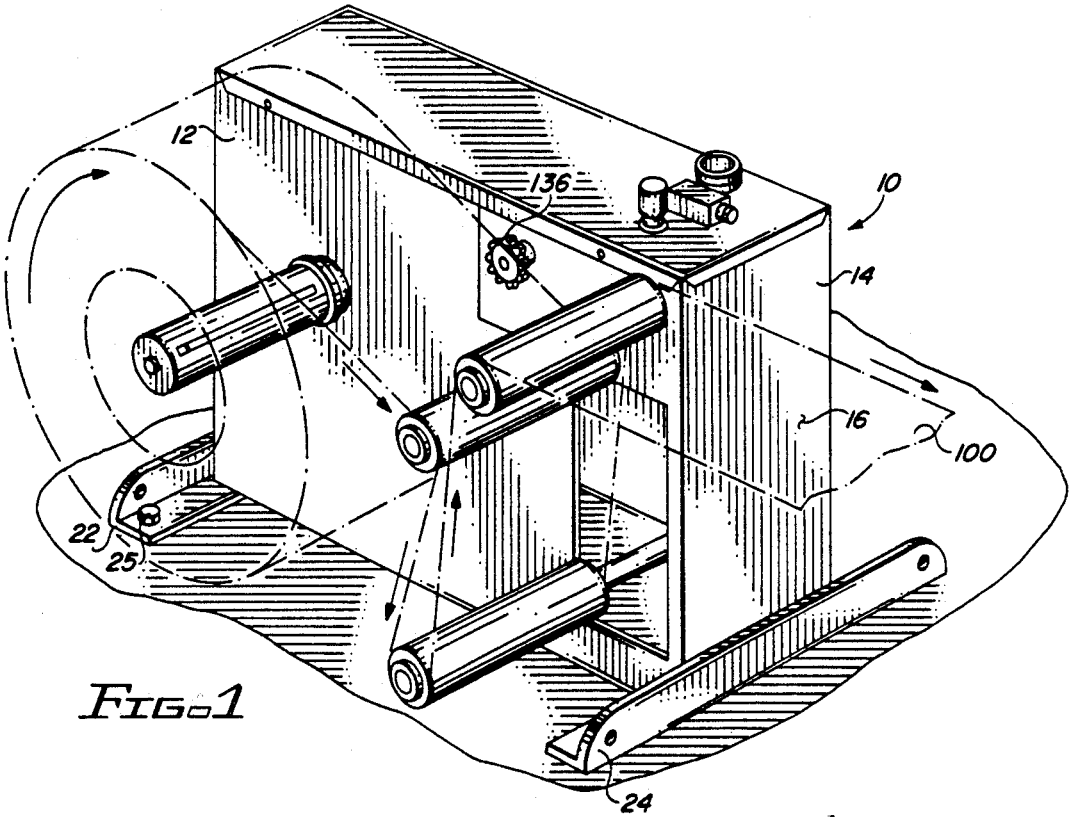
FIG. 1
FIG. 2
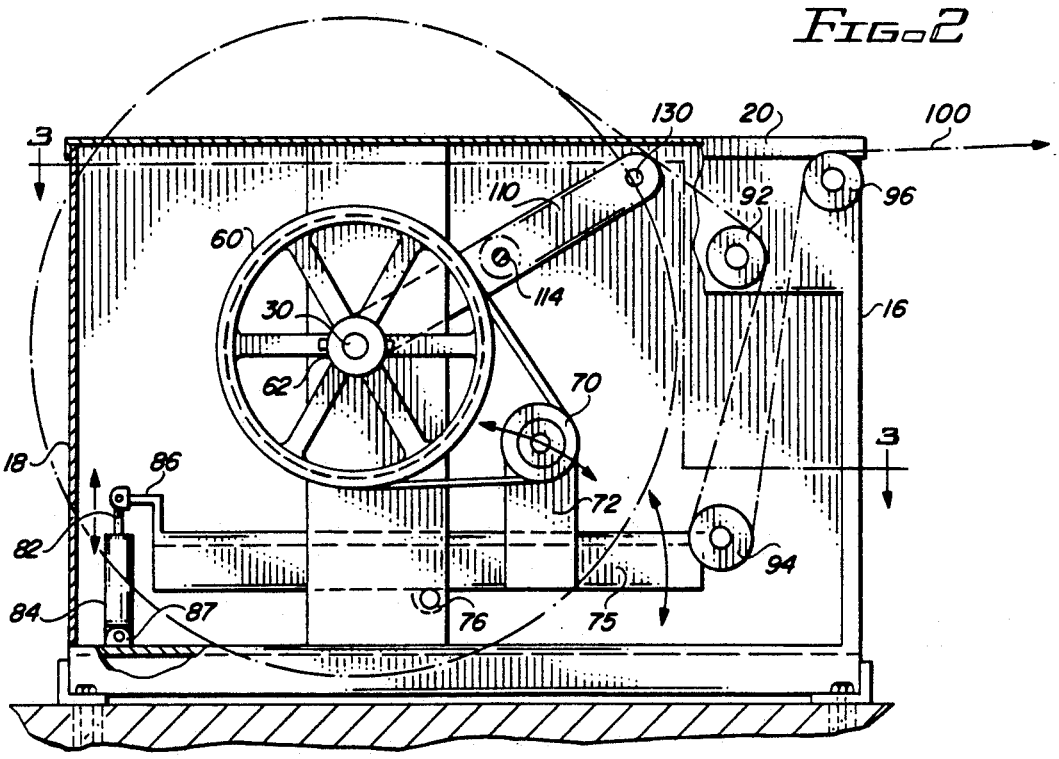

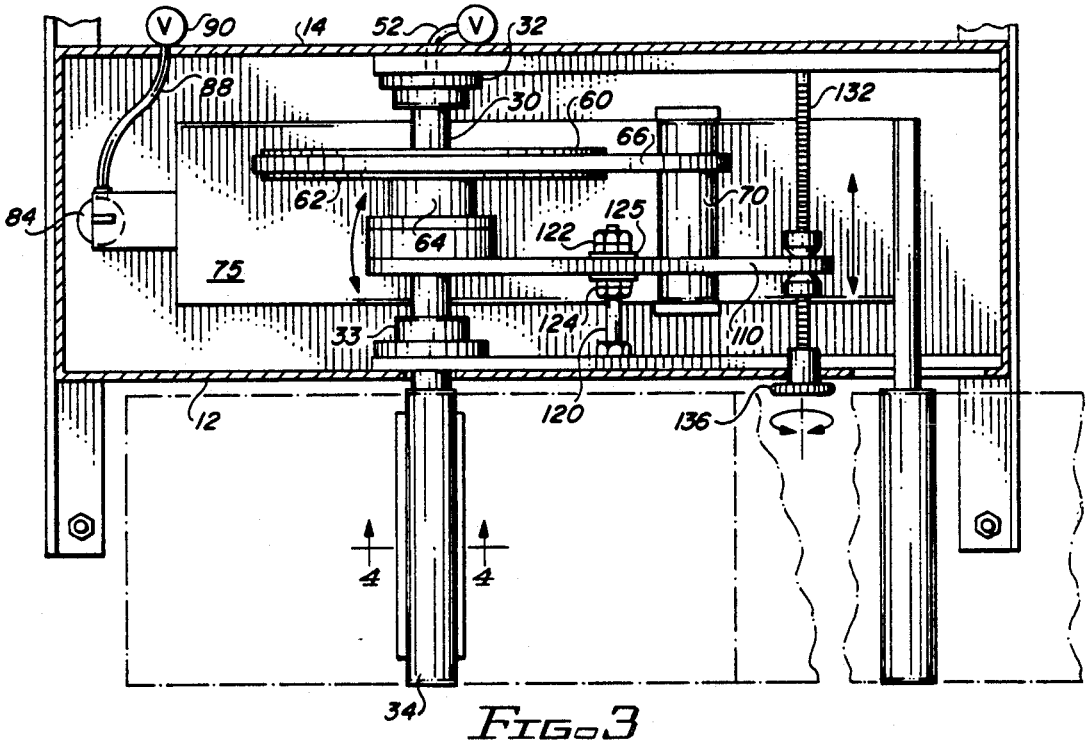
FIG. 3
FIG. 4
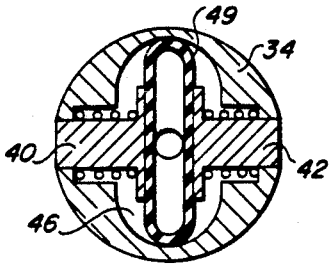
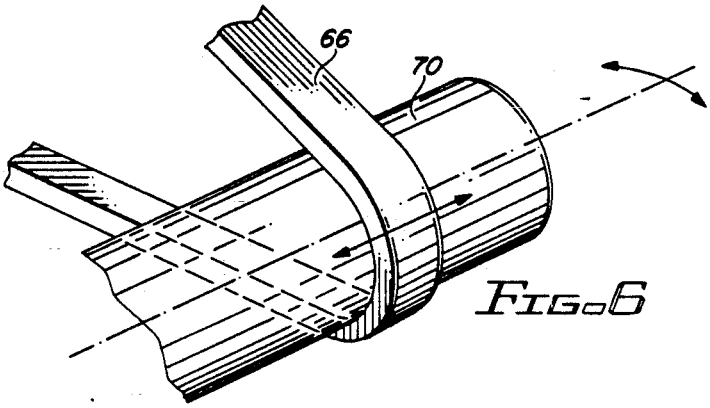
FIG. 6
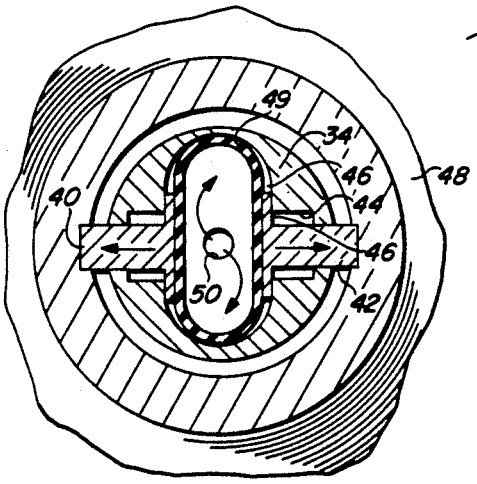
FIG. 5

UNWIND STATION

BACKGROUND OF THE INVENTION—FIELD OF THE INVENTION

The present invention relates to an unwind station and more particularly relates to an unwinding device for feeding a web of material to a printing press or a web flexographic converting system at a constant tension. In the printing industry, the term "web" generally refers to a large roll of paper or newsprint. In flexographic printing, the term "web" applies to various films such as polymeric films which are printed for such applications as labeling and the like. Typical presses for web flexographic printing are those of the type as manufactured by Mark Andy, Inc., typified by the Model 830.

DESCRIPTION OF THE RELATED ART

One particular problem in this type of web printing is uniformly feeding the material which is supplied as roll stock to the printing machine. Various approaches to this problem can be found in the prior art. In some instances, the roll stock is produced with holes on either side of the web which holes mate with sprockets on the rollers controlling the web tension. When the rollers are actuated to feed the web, the roller sprockets engage with the holes in the web to move the material forward.

These systems and others have inherent disadvantages in that they require special web stock with holes on either side which is expensive and also results in wasted material. These types of systems can also be misaligned tearing the web material.

Accordingly, there exists a need for a simple unwind station which is adaptable for use with a wide variety of web materials and which is usable with various types of flexographic presses.

SUMMARY OF THE INVENTION

Briefly, the present invention provides an unwind station which controls the tension of the web provided the press. A roll of feedstock is positioned on the arbor of the unwind shaft. The unwind shaft carries a large pulley having a V-belt which extends around a stationary cylindrical brake drum which compensates automatically for increased drag by increasing or decreasing brake pressure. For most printing jobs, once the initial tension is set by the press operator, no initial adjustment is necessary. The initial adjustment is established by a pneumatic cylinder secured to a beam arm which carries a brake drum. The beam arm is pivotally secured and the brake drum which is frictionally engaged by the belt extending around the pulley adjusts to provide the desired brake pressure to maintain the web at a constant tension. The web is fed from the roll around several idlers to the press.

In addition to the tensioning device, the unwind assembly including the unwind shaft on which the roll stocks mount, may be laterally positioned to provide side-lay adjustment for precise web alignment.

The above and other objects and advantages of the present invention will become more apparent from the following claims, description and drawings in which:

BRIEF DESCRIPTION OF THE DRAWINGS

FIG. 1 is a perspective view of the unwind station of the present invention with a roll of stock and the web feed shown in dotted;

FIG. 2 is a side view of the unwind station of the present invention with a part of the side wall broken away to better reveal the internal components;

FIG. 3 is a sectional view taken along line 3—3 of FIG. 2;

FIG. 4 is a sectional view taken through the arbor along line 4—4 of FIG. 3;

FIG. 5 is a view similar to FIG. 4 showing a roll of feed stock in place on the arbor; and FIG. 6 is a perspective detail view of the brake drum and belt.

DESCRIPTION OF THE PREFERRED EMBODIMENTS

Turning now to the drawings, the unwind station of the present invention is generally designated by the numeral 10 and includes a housing having opposite side walls 12 and 14, end walls 16 and 18 and top cover plate 20. The housing may be suitably fabricated from sheet steel and welded. Preferably cover 20 is removable to provide access to the interior of the housing. The housing is supported on base members consisting of angle irons 22 and 24 transversely secured as by welding to the opposite lower ends of the housing. Preferably the angle irons extend substantially beyond the side walls of the housing for stability and are provided with bores 25 for securement to a work surface adjacent the press. As indicated above, the unwind station of the present invention may be used with various presses and in connection with various types of feedstock.

Unwind shaft 30 extends transversely through the housing and is mounted in suitable bearing members 32 and 33 at the opposite interior side of side walls 12 and 14. The bearings absorb radial loads but will permit at least axial movement of shaft 30 for adjustment as will be explained hereafter. An arbor 34 is carried on the unwind shaft 30 and extends outwardly from side wall 14 a sufficient distance to accommodate the width of a roll of web material. As seen in FIGS. 4 and 5, the core of the roll 48 is slipped over the shaft section 34 and is secured in place by gripping blades 40 and 42. The gripping blades 40 and 42 extend longitudinally in recesses 44 in the arbor 34. The interior of arbor 34 defines a chamber 46 which receives an expandable bladder 49. Bladder 49 is connected to axially extending passage 50 which terminates at the opposite end of the shaft 30 at a fitting which may be connected to a suitable source of air pressure via line 52. Thus, once the roll 48 of web material is positioned on the arbor, bladder 48 is expanded forcing the gripping blades 40, 42 outwardly into engagement with the cylindrical core 46 of the roll.

Tension is applied to the roll carried on the shaft by means of a braking assembly which includes a pulley 60 which is secured to the shaft 30 at hub 62 by means of set screws 64. A belt 66, shown as a V-belt, extends around the pulley and around braking member or drum 70. Drum 70 is a non-rotating, hollow, cylindrical member of steel or similar material having a polished outer surface which frictionally engages the belt. Drum 70 is supported by bracket 72 welded to one end of the cylinder. The bracket 72 is secured to a beam arm 75 which extends longitudinally within the housing at a location below the pulley. Beam arm 75 is pivotally mounted to shaft 76 which extends transversely between the side walls of the housing. The end of the beam arm 75 opposite the braking drum is connected to the rod 82 of pneumatic cylinder 84. A rigid elbow connection 86 extends between the beam arm and the end of the cylinder rod 82. The lower end of the cylinder 84 is connected to the floor of the housing by a suitable clevis 87. The pneumatic cylinder is connectable to a source of air pressure by means of line 88 under the control of manually operable valve 90. A plurality of idlers 92, 94, and 96 extend outwardly from side wall 14 so that the web 102 from the roll 48 will extend around the idlers in the manner shown in FIG. 3 for uniformity of feed. The web feed 100 is substantially horizontal extending from idler 96.

The unwind station is also provided with side-lay adjustment to provide precise alignment of the web feed 100. The side-lay adjustment is accomplished by means of a side-lay arm 110 which has its lower end secured to hub 64 of the pulley 60. The arm may be attached to the pulley hub by any suitable mechanical means. The side-lay arm is provided with a bore 114 at an intermediate location which receives stud 120 extending into the housing from side wall 12. A pair of nuts 122 and 124 are in threaded engagement with the stud at opposite sides of the side-lay arm. Washers and compression spring assemblies 125 are interposed between the opposite sides of the side-lay arm and the nuts to allow the side lay arm lateral movement relative to the stud.

The upper end of the side-lay arm is provided with a threaded bore 130 which is in engagement with threaded shaft 132 which extends transversely between the side walls of the housing. One end of the shaft 132 is provided with an adjustment knob 136 which is rotatable in either direction. It will be apparent that rotation of the knob 136 in one rotational direction will impart rotation to shaft 132 causing the side-lay adjustment arm to pivot about the intermediate stud 120. This, in turn, will impart lateral movement to the pulley hub 62 and unwind shaft 30 causing arbor 34 on which the roll is mounted to be transversely moved to adjust the alignment of web 100. Rotation of knob 136 in the opposite rotational direction will move arbor 34 in the opposite direction.

It will be seen that the unwind station of the present invention is simple, dependable and can be used with a wide range of web materials and presses. In use, the core 46 of roll 48 of web material is positioned on arbor 34 and the internal bladder 50 inflated causing the blades to engage the interior surface of the core of the roll. The web material is then fed around idlers 92, 94 and 96 to the press. In operation, the web material is fed from the roll and the desired tension is established by regulating valve 90 to extend the piston 84 to apply the desired tensioning or braking force to the belt and pulley at the drum 70. Once the web tension is established, in most situations, no additional adjustment is necessary. The tensioning drum serves as a "dancer" to compensate automatically for increased or decreased drag by appropriately increasing or decreasing the braking force on the belt and pulley attached to the unwind shaft 30. Side-lay adjustment is accomplished at adjustment knob 36.

Thus, it will be seen the present invention is simple, effective and provides an unwind device in which web tensioning is automatically and effectively controlled. Further, the present device provides side-lay adjustment for web alignment and is adaptable for printing and other applications in which a web or film of stock is provided on a feed roll.

It will be obvious to those skilled in the art to make various changes, alterations and modifications to the invention described herein. To the extent such changes, alterations and modifications do not depart from the spirit and scope of the appended claims, they are intended to be encompassed therein.

I claim:

1. An unwind station for feeding a web of feed material from roll stock at substantially constant tension comprising:

(a) a housing having a base and upstanding side walls;

(b) an unwind shaft extending between said side walls and being mounted in bearings and having an arbor extending outwardly from one of said side walls for receiving said roll stock;

(c) means associated with said arbor for selectively engaging said roll stock whereby said roll stock and unwind shaft rotate in unison to feed a web;

(d) a pulley having a hub secured to said unwind shaft;

(e) a braking arm having opposite first and second ends and being pivotally mounted at an intermediate location, said first end of said arm having a braking member thereon and the said second end having biasing means attached thereto which biasing means applies a predetermined biasing force to the arm; and (f) a belt extending between said pulley and braking member whereby said braking member responds to maintain a predetermined constant tension on said web.

2. The unwind station of claim 1 wherein said means for selectively engaging said roll stock comprises blades extendable from said shaft and further including air bladder means selectively inflatable to extend said blades.

3. The unwind station of claim 2 including at least one idler roller adapted to receive said web and direct it in a generally horizontal feed position.

4. The unwind station of claim 1 wherein said braking member comprises a hollow cylinder having a friction surface.

5. The unwind station of claim 1 wherein said pulley is a V-pulley and said belt is a V-belt.

6. The unwind station of claim 1 further including side-lay adjustment means to laterally position said arbor to selectively align said web.

7. The unwind station of claim 1 wherein said biasing means comprises a pneumatic cylinder.

* * * * *